US007082634B1

(12) United States Patent
Hinds et al.

(10) Patent No.: US 7,082,634 B1
(45) Date of Patent: Aug. 1, 2006

(54) DIVIDABLE MATTRESS

(76) Inventors: Gloria Hinds, deceased, late of Brooklyn, NY (US); by Terence Hinds, legal representative, 451 Wyona St., Brooklyn, NY (US) 11207

( * ) Notice: Subject to any disclaimer, the term of this patent is extended or adjusted under 35 U.S.C. 154(b) by 797 days.

(21) Appl. No.: 10/303,989

(22) Filed: Nov. 25, 2002

(51) Int. Cl.
*A47C 21/00* (2006.01)

(52) U.S. Cl. ..... 5/690; 5/513
(58) Field of Classification Search ..... 5/690, 5/731, 513
See application file for complete search history.

(56) References Cited

U.S. PATENT DOCUMENTS 1,532,497 A 4/1925 Jones
2,471,977 A 5/1949 Power ..... 5/329
2,704,371 A * 3/1955 Liphart ..... 5/513
5,161,270 A * 11/1992 Najmabadi ..... 5/424
D360,775 S * 8/1995 Karkoska et al. ..... D6/383
5,555,581 A 9/1996 Woods ..... 5/502

* cited by examiner

*Primary Examiner*—Teri Pham Luu
*Assistant Examiner*—Fredrick Conley
(74) *Attorney, Agent, or Firm*—Goldstein Law Offices, P.C.

(57) ABSTRACT

A dividable mattress for use in providing separation between the bedmates of a bed. The dividable mattress has two dividers and two parallel slots running substantially from the head to the foot of the mattress. Each divider may be selectively deployed by extending the divider bottom within one of the slots when separation of the bedmates is desired. The dividable mattress may also be used as an ordinary undivided mattress when the dividers are removed from their slots, and the slots are hidden by a flap which extends along the length of the slot and which may be secured to the top surface of the mattress with fastening material. When the dividers are not deployed, the dividable mattress looks substantially identical to an undivided mattress.

7 Claims, 2 Drawing Sheets

DIVIDABLE MATTRESS

BACKGROUND OF THE INVENTION

1. Field of the Invention

The invention generally relates to mattresses, and in particular it relates to mattresses which may be partitioned.

2. Description of the Related Art

A great number of people share a bed with a partner or spouse. However, it may be difficult for a bedmate to get a restful sleep if the other bedmate tosses and turns during the night. Additionally, if one of the bedmates has a contagious illness, there is a danger of infection of the uninfected bedmate. Furthermore, if one of the bedmates wishes to read or engage in activities that require artificial lighting, the light may make it difficult for the other bedmate to get a restful sleep. Consequently, there is a need for a mattress which affords some degree of separation of the bedmates when this is desirable.

Various devices have been created which attempt to address some of the objects of this invention. U.S. Pat. No. 1,532,497 to Jones appears to show a mattress which has a central projecting portion which divides a bed to prevent the spread of an illness. However, Jones contemplates a mattress in which the projecting portion is an integral part of the mattress and it therefore cannot be used as a regular mattress.

U.S. Pat. No. 2,471,977 to Power appears to show a bed partition which comprises a central board which is connected to the head and foot of two separate mattresses of a double bed. However, Power contemplates a divider which extends between two separate adjacent mattresses. Accordingly, Power fails to provide a single mattress which is capable of providing the bedmates with some privacy.

U.S. Pat. No. 5,555,581 to Woods appears to show a bed bridge for joining two mattresses. However, Woods fails to provide a mattress which may be used for separating the occupants of the two mattresses when desired.

While these units may be suitable for the particular purpose employed, or for general use, they would not be as suitable for the purposes of the present invention as disclosed hereafter.

SUMMARY OF THE INVENTION

It is an object of the invention to produce a mattress which allows two bedmates to safely sleep in the same bed even if one of them has a contagious illness. Accordingly, the dividable mattress has dividers which extend upward between the two halves of a twin bed to form a barrier which prevents the spread of germs to the uninfected bedmate.

It is another object of the invention to produce a mattress which effectively muffles the sounds which are made by one of the bedmates. Accordingly, the dividable mattress has a divider which effectively reduces the transmission of sound from one side of the bed to the other. This is particularly useful for reducing the sounds of sneezing or coughing of a sick bedmate.

It is yet another object of the invention to produce a mattress which allows one of the bedmates to read or engage in other activities which require light without disturbing the sleep of the other bedmate. Accordingly, the dividable mattress has dividers which effectively prevent light from one side of the bed from reaching the other side.

It is still another object of the invention to produce a mattress that may be used as a single, undivided mattress when separation of the bedmates is not desired. Accordingly, the dividable mattress can be easily converted to an undivided mattress by removing the dividers and covering the slots into which the dividers fit.

It is an additional object of the invention to produce a mattress which has the capability of separating the bedmates when desired, and yet looks in all respects like an undivided mattress when the dividers are not being deployed. Accordingly, the slots into which the dividers fit may be covered by flaps of cloth which are secured by fastening material when the dividers are not being deployed.

It is another object of the invention to produce a mattress which gives each bedmate an overall sense of privacy when this is desired. Accordingly, the dividable mattress has dividers which may be deployed whenever the bedmates feel a need for privacy.

The invention is a dividable mattress for use in providing separation between the bedmates of a bed. The dividable mattress has two dividers and two parallel slots running substantially from the head to the foot of the mattress. Each divider may be selectively deployed by extending the divider bottom within one of the slots when separation of the bedmates is desired. The dividable mattress may also be used as an ordinary undivided mattress when the dividers are removed from their slots, and the slots are hidden by a flap which extends along the length of the slot and which may be secured to the top surface of the mattress with fastening material. When the dividers are not deployed, the dividable mattress looks substantially identical to an undivided mattress.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
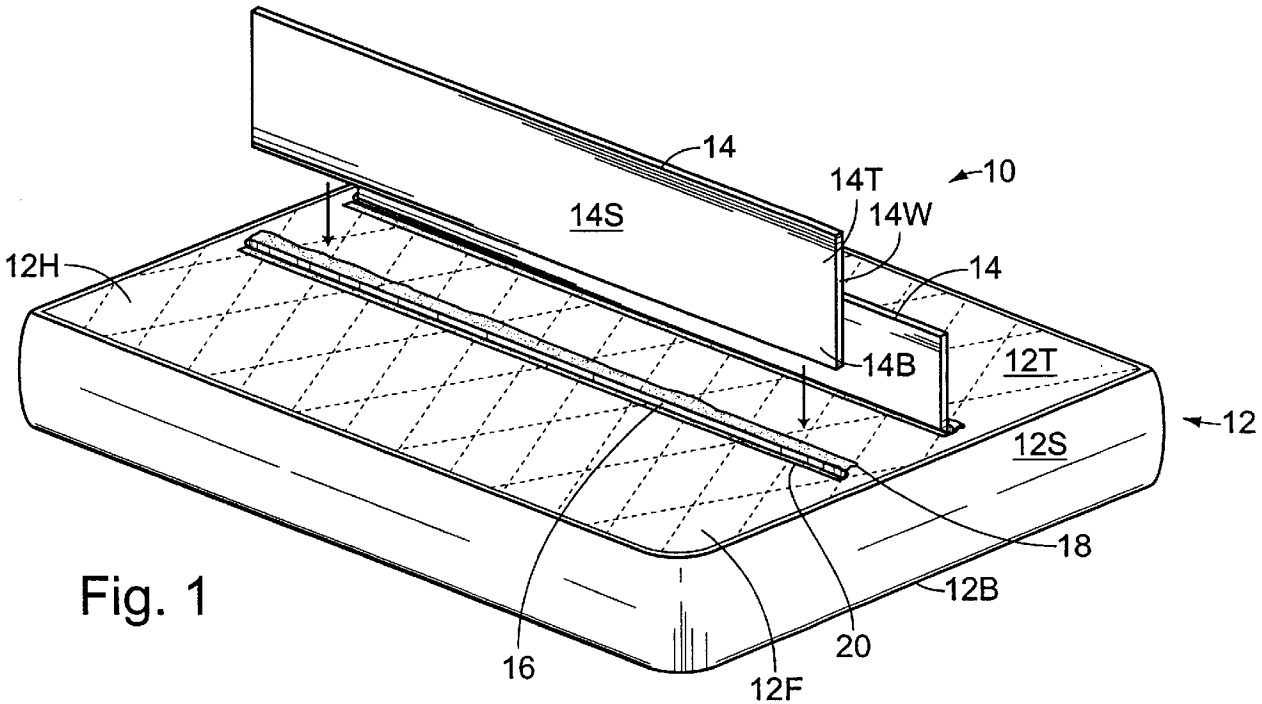
FIG. 1 is a perspective view of the dividable mattress with one divider in one slot and the other divider positioned for insertion into the other slot.
Figure 2:
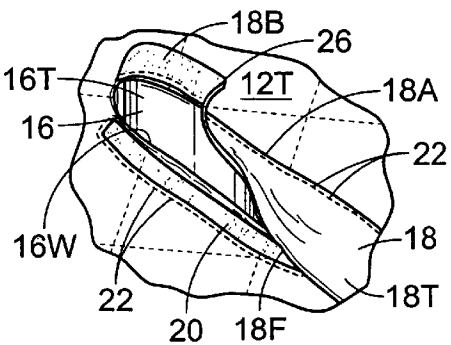
FIG. 2 is a perspective view illustrating the flap which is used to cover the slot.
Figure 3:
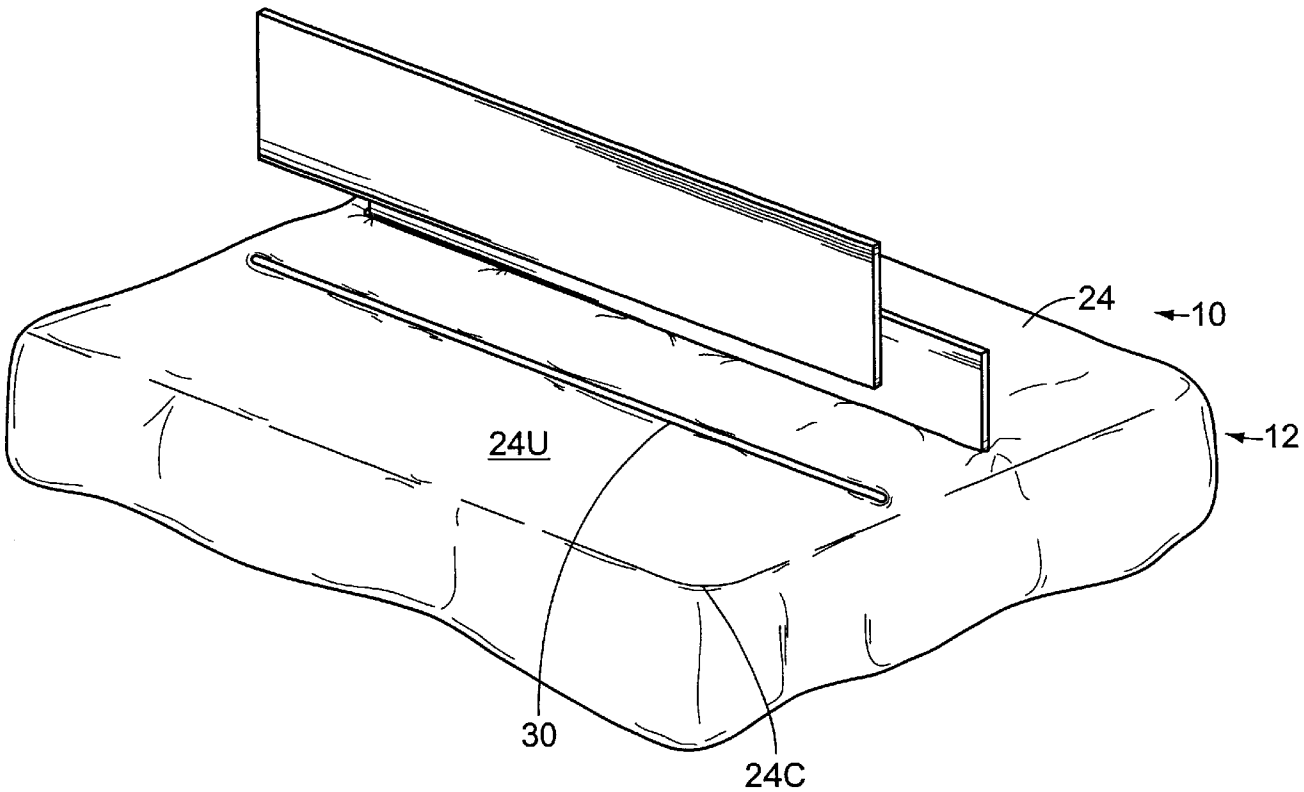
FIG. 3 is a perspective view of the dividable mattress after it has been fitted with a slit sheet.

FIG. 1 illustrates a view of the dividable mattress 10 comprising a mattress portion 12, having a top surface 12T, a bottom surface 12B, side surfaces 12S, a head portion 12H, a foot portion 12F, two longitudinal slots 16 which extend substantially from the head portion 12H to the foot portion 12F, and two dividers 14 which may be positioned within the slots 16 when separation between the bedmates is desired. Turning momentarily to FIG. 3, the dividable mattress 10 also has slit sheets 24 having slits 30 which are sized to accommodate the divider bottoms 14B, thereby allowing the slit sheets 24 to effectively cover the dividable mattress 10 even when the dividers 14 are deployed. Turning momentarily to FIG. 2, each slot 16 has a slot opening 16T, and two slot walls 16W which extend vertically downward from the slot opening 16T on the top surface 12T of the mattress portion 12 partially toward the bottom surface 12B. The two slot walls 16W of each slot 16 are separated from each other along their entire length by a distance which is wide enough to accommodate the width of the sides 14W of the dividers 14. Each slot 16 has a flap 18 running along one of the slot walls 16W in proximity to the slot opening 16T which is selectively attachable to an opposing strip 20 of material which runs along the opposing slot wall 16W in proximity to the slot opening, for covering the slots 16 when the dividers 14 are not being deployed. Each divider 14 has a divider top 14T, a divider bottom 14B, and divider sides 14S and 14W. One divider 14 has been placed within one slot 16 and the other divider 14 is positioned to be inserted into its slot 16. In particular, the divider bottom 14B is extended vertically downward into the slot opening 16T. The slot 16 extends downward within the mattress 12 from the mattress top 12T to the mattress bottom 12B a distance which affords stability to the divider 14 after it has been placed within its slot 16. The side 14W of the divider 14 has a width which is narrow enough to allow the divider 14 to be inserted within the slot opening 16T and broad enough so that the divider 14 fits snugly between the two walls 16W of the slot 16. In FIG. 1, the mattress portion 12 has not been covered by a slit sheet 24.

FIG. 2 illustrates a view showing one of the flaps 18 being deployed to cover one of the slot openings 16T when the dividers 14 are not being used. Each flap 18 has a flap top 18T and a flap bottom 18B. The flap top 18T is primarily shown, with a corner 26 folded over so that a portion of the flap bottom 18B may be seen. In FIG. 2, the flap bottom 18B is stippled to indicate that it has fastening material attached. Each flap 18 has an attached side 18A and a free side 18F. Each flap 18 is attached to the top surface 12T of the mattress portion 12 at its attached side 18A in proximity to one of the slot walls 16W. Likewise, the opposing strip 20 has fastening material and is attached in proximity to the opposing slot wall 16W at a position which maximizes overlap of the fastening material on the flap bottom 18B with the fastening material on the opposing strip 20. The flap 18 has stitches 22 which secure the attached side 18A near one of the slot walls 16W in proximity to the slot opening 16T. Similarly, the opposing strip 20 has stitches 22 which attach it to the top surface 12T of the mattress portion 12 in proximity to and along the entire length of the opposing slot wall 16W in proximity to the slot opening 16T. Although FIG. 2 illustrates the slot 16 being covered by mating the fastening material on the flap bottom 18B with the fastening material on the opposing strip 20, the slot 16 may also be covered by mating a zipper strip which may be located on the flap 18 with another zipper strip located on the opposing strip 20.

Turning momentarily to FIG. 3, the dividable mattress 10 further comprises a slit sheet 24 which may be fitted onto the mattress portion 12 having two parallel and evenly spaced slits 30 on its upper surface 24U of the same size and shape as the slot openings 16T. FIG. 3 illustrates a perspective view of the dividable mattress 10 after it has been fitted with a slit sheet 24. The slit sheet 24 has an upper surface 24U having slits 30 which overlap the slot openings 16T when the sheet has been fitted to the mattress portion 12, thereby allowing the dividers 14 to be fully extended through the slits 30 in the sheet 24 and into the underlying slots 16.

In use, the user determines whether to deploy the dividers 14 to separate the bedmates of the dividable mattress 10. If the dividers 14 are to be deployed, the user removes the regular "continuous" sheet from the mattress portion 12. The user then uncovers the slot opening 16T by peeling the fastening material on the flap bottom 18B from the fastening material on the underlying opposing strip 20. The user then fits the slit sheet 24 onto the mattress portion 12. Once the slit sheet 24 has been fitted over the mattress portion 12, the slits 30 which extend through the upper surface 24U of the slit sheet 24 will overlap the slot openings 16T. In this regard, the slit sheet 24 may be adjusted by a user pulling on the corners 24C of the slit sheet 24, until the slits 30 in the sheet are positioned substantially over the slot openings 16T. The slits 30 on the slit sheet 24 may be reinforced by a sleeve around the periphery of the slits so that the slits 30 will not rip easily. Once the mattress portion 12 has been fitted with the slit sheet 24, the user extends the bottom 14B of one of the dividers 14 into one slot 16. The user then extends the other divider 14 into the other slot 16 in like manner. The dividable mattress 10 now affords privacy to the two bedmates.

In conclusion, herein is presented a dividable mattress having two dividers which may be selectively positioned within slots which extend substantially from the head of the bed to the foot of the bed, for providing the occupants of the bed with some privacy. The invention is illustrated by example in the drawing figures, and throughout the written description. It should be understood that numerous variations are possible, while adhering to the inventive concept. Such variations are contemplated as being a part of the present invention.

What is claimed is:

1. A dividable mattress for providing separation between bedmates of a bed, to be used in conjunction with a bed frame, comprising:

a) a mattress portion, having a top surface, a bottom surface, a head portion, a foot portion, and side surfaces, at least one longitudinal slot which extends substantially parallel to the side surfaces vertically downward from the top surface toward the bottom surface of the mattress substantially from the head portion to the foot portion, said slot having a slot opening at the top surface defined by opposing slot walls extending partially downward from the top surface toward the bottom surface; and b) at least one divider, having a top portion and a bottom portion, wherein the bottom portion of the divider may be positioned within the slot when separation of the bedmates is desired, and the divider is dimensioned such that when the bottom portion is fully positioned into the slot, the top portion of the divider extends vertically above the top surface of the mattress portion.

2. The dividable mattress as recited in claim 1, comprising two slots and two dividers, wherein the bottom portion of each divider may be positioned within one of the slots when separation of the bedmates is desired.

3. The dividable mattress as recited in claim 2, wherein each slot further has a longitudinal flap having a flap top and a flap bottom, in proximity to one of the opposing flap walls near the slot opening, running along the length of the slot, which is selectively attachable to an opposing strip of material located on the top surface of the mattress portion in proximity to the opposing slot wall, when the slots are not being utilized to support the dividers.

4. The dividable mattress as recited in claim 3, wherein the flap bottom and the opposing strip both have fastening material whereby the flap bottom may be secured to the opposing strip by mating the fastening material on the flap bottom with the fastening material on the opposing strip.

5. The dividable mattress as recited in claim 4, further comprising sheets having top surfaces and slits located on their top surfaces, which may be fitted onto the mattress portion when the dividers are being deployed, said slits being of the same size and shape as the slot openings, and located at a position on the top surface of the sheets which allows the slit openings to substantially overlap the slot openings when the sheet is installed on the mattress portion.

6. A method of using a dividable mattress to separate bedmates of a bed, said dividable mattress comprising a mattress portion, having a top surface, a bottom surface, a head portion, a foot portion, and side surfaces, a longitudinal slot which extends vertically downward from the top surface to the bottom surface of the mattress substantially from the head portion to the foot portion, said slot having a slot opening and opposing slot walls extending partially downward from the top surface to the bottom surface, said dividable mattress further comprising a divider, having a top portion and a bottom portion, comprising the steps of:

a) determining if separation of the bedmates by the divider is desirable;

b) positioning the divider within the slot by extending the bottom of the divider into the slot;

c) using the dividable mattress by the bedmates for sleeping or other activities with the divider in place.

7. A method of using a dividable mattress to separate bedmates of a bed, said dividable mattress comprising a mattress portion, having a top surface, a bottom surface, a head portion, a foot portion, and side surfaces, two longitudinal slots which extend vertically downward from the top surface to the bottom surface of the mattress substantially from the head portion to the foot portion, said slots having slot openings and opposing slot walls extending partially downward from the top surface to the bottom surface, each slot further having a longitudinal flap having a flap top and a flap bottom, in proximity to one of the opposing flap walls near the slot opening, running along the length of the slot opening, wherein the flap bottom and the opposing strip both have fastening material whereby the flap bottom may be secured to the opposing strip by mating the fastening material on the flap bottom with the fastening material on the opposing strip when the slots are not being utilized, said dividable mattress further comprising two dividers, each having a top portion and a bottom portion, and sheets having top surfaces and slits located on their top surfaces, which may be fitted onto the mattress portion when the dividers are being deployed, said slits being of the same size and shape as the slot openings, and located at a position on the top surface of the sheets which allows the slit openings to substantially overlap the slot openings when the sheet is installed on the mattress portion, comprising the steps of:

a) removing the non-slit sheet from the mattress portion by a user;

b) uncovering the slot opening by peeling the fastening material on the flap bottom from the fastening material on the underlying opposing strip;

c) fitting the slit sheet onto the mattress portion thereby causing the slits which extend through the upper surface of the special sheet to substantially overlap the slot opening;

d) positioning one of the dividers within a slot by extending the bottom of the divider into the slot;

e) positioning the other divider within the other slot by extending the bottom of the divider within the other slot; and f) using the dividable mattress by the bedmates for sleeping or other activities with the dividers in place.

* * * * *